US008506758B2

(12) United States Patent
Ruuska

(10) Patent No.: US 8,506,758 B2
(45) Date of Patent: Aug. 13, 2013

(54) SYSTEM FOR GUIDING WEB PATCHING USING A RE-REELER

(75) Inventor: Hannu Ruuska, Muurame (FI)

(73) Assignee: Metso Automation Oy, Vantaa (FI)

( * ) Notice: Subject to any disclaimer, the term of this patent is extended or adjusted under 35 U.S.C. 154(b) by 0 days.

(21) Appl. No.: 13/128,758

(22) PCT Filed: Nov. 24, 2009

(86) PCT No.: PCT/FI2009/050951

§ 371 (c)(1),
(2), (4) Date: May 25, 2011

(87) PCT Pub. No.: WO2010/061057

PCT Pub. Date: Jun. 3, 2010

(65) Prior Publication Data

US 2011/0226434 A1 Sep. 22, 2011

(30) Foreign Application Priority Data

Nov. 25, 2008 (FI) ..... 20086127

(51) Int. Cl.
*D21F 7/04* (2006.01)
*D21F 7/06* (2006.01)
*G01N 21/89* (2006.01)

(52) U.S. Cl.
USPC .... 162/263; 162/265; 162/283; 162/DIG. 10; 700/129; 226/11; 242/370; 242/534; 356/430

(58) Field of Classification Search
USPC ..... 162/252, 263, 265, 272, 283, 285–286, 162/DIG. 10; 700/83, 122, 126–129; 242/534, 242/370, 487.3; 348/88, 111; 226/9–11; 356/429–430
See application file for complete search history.

(56) References Cited

U.S. PATENT DOCUMENTS 3,350,262 A * 10/1967 Cummins ..... 162/255
5,949,550 A * 9/1999 Arndt et al. ..... 356/430
6,299,730 B1 10/2001 Broek et al.
8,197,078 B2 * 6/2012 Ruuska ..... 362/11
2002/0176617 A1 11/2002 Simonetti (Continued)

FOREIGN PATENT DOCUMENTS

DE 196 32 988 C1 1/1998
EP 979995 A1 * 2/2000

(Continued)

OTHER PUBLICATIONS

Finnish Search Report issued in Finnish Application No. 20086127 dated Jun. 5, 2009 (with translation).

*Primary Examiner* — Jose A Fortuna
(74) *Attorney, Agent, or Firm* — Oliff & Berridge, PLC

(57) ABSTRACT

A method for guiding web patching, using a re-reeler, in connection with a paper machine and an off-line coating machine, in which method a defect map of the web is created on the paper machine, to show deviations some of which are shown on the coating machine, using selected criteria, to the operator, the deviations being patched using the re-reeler, guided by the defect map and preset patching rules. On the coating machine, the virtual location of the selected deviations is monitored through the coating machine and if a possible web break occurs, a deviation is localized relative to the web break, and on the basis of this monitoring, feedback is provided to the patching rules of the re-reeler, in order to optimize them.

3 Claims, 4 Drawing Sheets

(56) References Cited

U.S. PATENT DOCUMENTS

| | | | | |
|---|---|---|---|---|
| 2003/0117492 | A1* | 6/2003 | Jokela | 348/88 |
| 2004/0107061 | A1* | 6/2004 | Ruuska | 702/82 |
| 2004/0112560 | A1* | 6/2004 | Yamashita et al. | 162/263 |
| 2005/0008765 | A1 | 1/2005 | Karjanmaa | |
| 2005/0199831 | A1 | 9/2005 | Aimonen et al. | |
| 2005/0254701 | A1 | 11/2005 | Aimonen et al. | |
| 2006/0090319 | A1 | 5/2006 | Howe | |
| 2006/0217831 | A1* | 9/2006 | Butterworth et al. | 700/126 |
| 2007/0176040 | A1* | 8/2007 | Asikainen et al. | 242/534 |
| 2009/0060316 | A1* | 3/2009 | Ruuska | 382/141 |
| 2010/0214416 | A1* | 8/2010 | Ruuska | 348/159 |
| 2011/0226434 | A1* | 9/2011 | Ruuska | 162/198 |

FOREIGN PATENT DOCUMENTS

| | | | | |
|---|---|---|---|---|
| EP | 2124041 | A2 | * | 11/2009 |
| WO | WO 02075295 | A1 | * | 9/2002 |
| WO | WO 03081219 | A1 | * | 10/2003 |
| WO | WO 2007/096475 | A1 | | 8/2007 |
| WO | WO 2007088250 | A1 | * | 8/2007 |
| WO | WO 2008/028997 | A2 | | 3/2008 |
| WO | WO 2010061057 | A1 | * | 6/2010 |

* cited by examiner

SYSTEM FOR GUIDING WEB PATCHING USING A RE-REELER

TECHNICAL FIELD

The present invention relates to a method for guiding web patching, using a re-reeler, in connection with a paper machine and an off-line coating machine, in which method a defect map of the web is created on the paper machine, to show deviations to the operator, the said deviations being patched using the re-reeler, guided by the defect map and preset patching rules. The invention also relates to a corresponding system, in connection with a paper machine, re-reeler, and off-line coating machine. By way of an analogy, it is possible to speak of an increase in the efficiency of the coating machine, because the patching of the web is the most significant factor in it.

BACKGROUND OF THE INVENTION

Systems are known from the prior art for monitoring deviations in a web being coated, on an off-line coating machine. In these systems, a defect map of the web is created, based on defect detection that has taken place on the fibre-web machine, which is then displayed to the operators of the off-line coating machine. More specifically, the defect map created on the basis of defect detection taking place on the fibre-web machine prior to reeling is synchronized for the coating machine, where is it displayed to the operators. The defect maps can be further transferred to other subsequent process stages. In addition to this, the post-coating quality can be monitored by imaging the coating web and displaying the deviations found as a defect map. On the basis of these two defect maps, the quality of the web arriving at coating can be seen, as can the quality of the web leaving coating. The defect map, which is imaged after coating, is typically shown in the same display as the defect map that has been imaged prior to coating. By showing the defect maps on the same display, the operator can easily see how the original deviations have changed during coating, provided the web does not break during coating. A method and apparatus for monitoring a rapidly moving web, in which event chains are detected from the web by means of real-time image analyses and displayed in essentially real time, are known from PCT publication WO 2007/096475 A 1.

In the apparatuses according to the prior art, the paper machine, re-reeler, and coating machine are independent units, between which information on deviations causing web breaks on the coating machine is transferred poorly. The poor transfer of information between the units considerably hinders the investigation of the cause-effect relationships of the deviations causing web breaks.

BRIEF SUMMARY OF THE INVENTION

The invention is intended to create a new type of method and system for guiding patching using a re-reeler, in connection with a paper machine and an off-line coating machine. The method permits better investigation of the cause-effect relationship, particularly in break situations. The characteristic features of the present invention are stated in the accompanying Claims. The invention is also intended to create a system for monitoring defects of a web being coating using an off-line coating machine. By means of the system according to the invention, the preceding processes can be provided with better feedback than previously. In the system according to the invention, the movement of a deviation detected in the previous process stages is monitored with the aid of virtual monitoring, which takes place by monitoring in real time the location, at the coating machine, of a point depicting the deviation on the machine screen, on the basis of an animated web map of the coating machine. The web map shows the horizontal dimensions of the coating machine web, the critical points on the coating machine, and a point showing each deviation to be monitored. The critical points on the coating machine are, for instance, the coating machine's coating stations. On the other hand, it is good to indicate the defect-detection cameras on the machine screen. The location of a point depicting a deviation, in virtual monitoring, using an animated web map, relates correctly, in terms of speed and location, to the actual location of the deviation on the coating machine (web speed). In virtual monitoring, the location of the animated point depicting a deviation on the animated web map is calculated on the basis of the real location information and the web speed of the coating machine. With the aid of virtual monitoring, it is possible to decide the location of a deviation causing a web break, relative to the critical points on the coating machine and to return the corresponding images taken by the cameras to be displayed to the operator.

In one embodiment, the system includes means for monitoring the web at the coating section and for finding deviations in the web using selected criteria, the analysis means for connecting each deviation with a deviation shown in the defect map by selected criteria or ascertaining it to be a new deviation, and display means for showing selected deviations in at least one selected position. In one preferred embodiment, the two and three most significant deviations are monitored virtually through the entire coating machine by showing animated images of them automatically on the machine screen. Monitoring of the web considerably facilitates the investigation of the cause-effect relations of web breaks.

In addition, the invention is intended to create an off-line coating machine, in which there is a system for monitoring deviations in the web being coated. By means of the off-line coating machine according to the invention, breaks can be avoided better than previously.

Here, the term web refers to board or paper webs. For its part, the term fibre-web machine, which precedes the off-line coating machine, refers to web-forming machines that manufacture board or paper. An off-line coating machine includes an unwinder, a coating section, and a winder. The coating section includes a drying section. Before the coating section, a defect map of the web being coated is formed, in order to show deviations. The defect map to be shown is created on the basis of defect detection taking place on the fibre-web machine, or by imaging the web after unwinding before the coating section. The types of deviations that enter the coating section are seen from the relevant defect map. In addition, at the coating section the web is monitored automatically, when web deviations are detected using selected criteria. The automatic monitoring can take place using machine vision or some other imaging system. The visualization of the formation of each deviation increases the possibility of preventing breaks and deviations, thus increasing the machine's efficiency.

A set of machine-direction co-ordinates of the web is attached at the paper machine to the edge of the web with colour-coded marks. A tachometer measures the length of the area between the codes. Each deviation detected is connected by means of selected criteria to a deviation shown in the defect map, or is ascertained to be a new deviation. A selected deviation that is detected automatically during monitoring is shown to the operator from a selected position in the coating section. When the detected deviation is connected with a deviation shown in the defect map using the selected criteria, or is ascertained to be a new deviation, the deviation can be monitored through the entire process after they have been found. When deviations are followed through the process, it is possible to see what kinds of deviation cause problems. Monitoring also makes it possible to see what deviations, which appear harmless before coating, cause problems during coating. The problems appear either as a worsening of the deviations, or even as breaks.

In one preferred embodiment, a high-speed camera reads the location of the colour code and the edge of the web. Immediately after the first colour code is read by the colour-code reader, a virtual position calculation can be created on the basis of the colour code and the tachometer reading. Web breaks can also be detected with the aid of the high-speed camera.

In one embodiment, selected deviations are shown in real time. When displaying deviations in real time, they are shown as quickly as possible, preferably within one second. Displaying the images in real time to the operator gives the operator more time to react to events and, for example, to prevent a break. When implementing the display of images in real time, the images are analyzed at least at the imaging frequency after they are taken, i.e. the images are not stored in a cache memory, but are analyzed immediately.

On the basis of the monitoring taking place in the coating section, feedback is preferably provided for the process stages preceding the coating machine by updating the deviations causing web breaks on the coating machine into the patching rules. The information obtained when monitoring the coating section allows feedback to be sent to those working on the re-reeler and the fibre-web machine. At its simplest, feedback can be taken care of by making a telephone call to someone working in the previous process stage, who can, on the basis of the feedback, examine the defect map to reduce the described deviations. Generally, the patching rules of the re-reeler are a computer application, which uses selected criteria to select deviations from the defect map. Naturally, all deviations cannot be patched, only those that meet the preset criteria for the patching rules. The criterion for a defect to be patched is usually a specific boundary size, but the type of deviation will also affect the matter. The feedback is preferably entered in the system, i.e. new criteria are defined in the system for patching rules for the computer application, by means of which it classifies the deviations. Updates to the patching rules in the computer application are preferably made directly on the coating machine. Those working on the fibre-web machine can see the point of origin of a deviation interfering with coating and take steps to eliminate it. Feedback is preferably given to those working on the re-reeler, as those working on the re-reeler can remove deviations interfering with coating, which appear in the base web, which is typically referred to as the base paper.

Thus, feedback makes it possible to deal with precisely the right deviations, as, for example, there is no need to react to all deviations that appear as light-coloured streaks by removing them. When those working at the re-reeler receive accurate information as to what kinds of deviations worsen during coating, or even cause breaks, deviations that will probably cause problems during coating can be removed. Thanks to the information that is more accurate than in the prior art, it is also possible to partly avoid the unnecessary patching of some deviations that will not cause web breaks. Because using the method according to the invention provides a new type of information on the coating process, information can be given to the preceding processes on deviations that have not previously been known to significantly interfere with the coating event.

In a third embodiment, the web is monitored automatically between the unwinder and the coating section. Information is then obtained on defects that have arisen after re-reeling. As the deviations in the web are known more accurately, the behavior of the web in coating can be forecast better. The cause-effect relations will also be more apparent.

In a fourth embodiment, the defect map formed of the web being manufactured on the fibre-web machine is synchronized for the coating section, on the basis of automatic monitoring between the unwinder and the coating section. Thus, the synchronization is performed more accurately than previously, allowing defects found on the web to be ascertained with greater probability as being due to a defect in the web.

In a fifth embodiment, in which the coating section includes at least one coating station and at least one drying station, machine vision is used to monitor the web at the coating station. When imaging the web at the coating station, breaks caused by deviations will be seen more than when imaging the web elsewhere in the coating section, as typically about 80% of breaks take place at the coating station. If a break is seen immediately when it happens, the break blades can be used considerably more quickly than before, which, for its part, will facilitate getting the machine quickly back into operating condition. In other words, by seeing a break as soon as possible, the break blades can be used quickly, thus reducing tangling in the coating machine. As the coating machine becomes entangled less frequently and less seriously than previously, less time than previously need be used for maintenance and washing.

In a sixth embodiment, the automatic monitoring takes place using machine vision. Machine vision includes imaging using cameras, while examination of the images takes place mechanically using a computer, i.e. automatically. Using machine vision, information on the web is obtained, on the basis of which many different kinds of analysis can be performed, in order to connect deviations. Machine vision allows the operator to be shown an image of the defect.

More specifically, the invention is characterized by the virtual location of deviations selected on the coating machine to be monitored through the coating machine, and in the event of a possible web break for the deviation to be localized relative to the web break, and on the basis of this monitoring feedback is given to the patching rules of the re-reeler, in order to optimize them.

BRIEF DESCRIPTION OF THE DRAWINGS

In the following, the invention is examined in detail with reference to the accompanying drawings showing some applications of the invention, in which.

DETAILED DESCRIPTION OF THE INVENTION

Figure 1A:
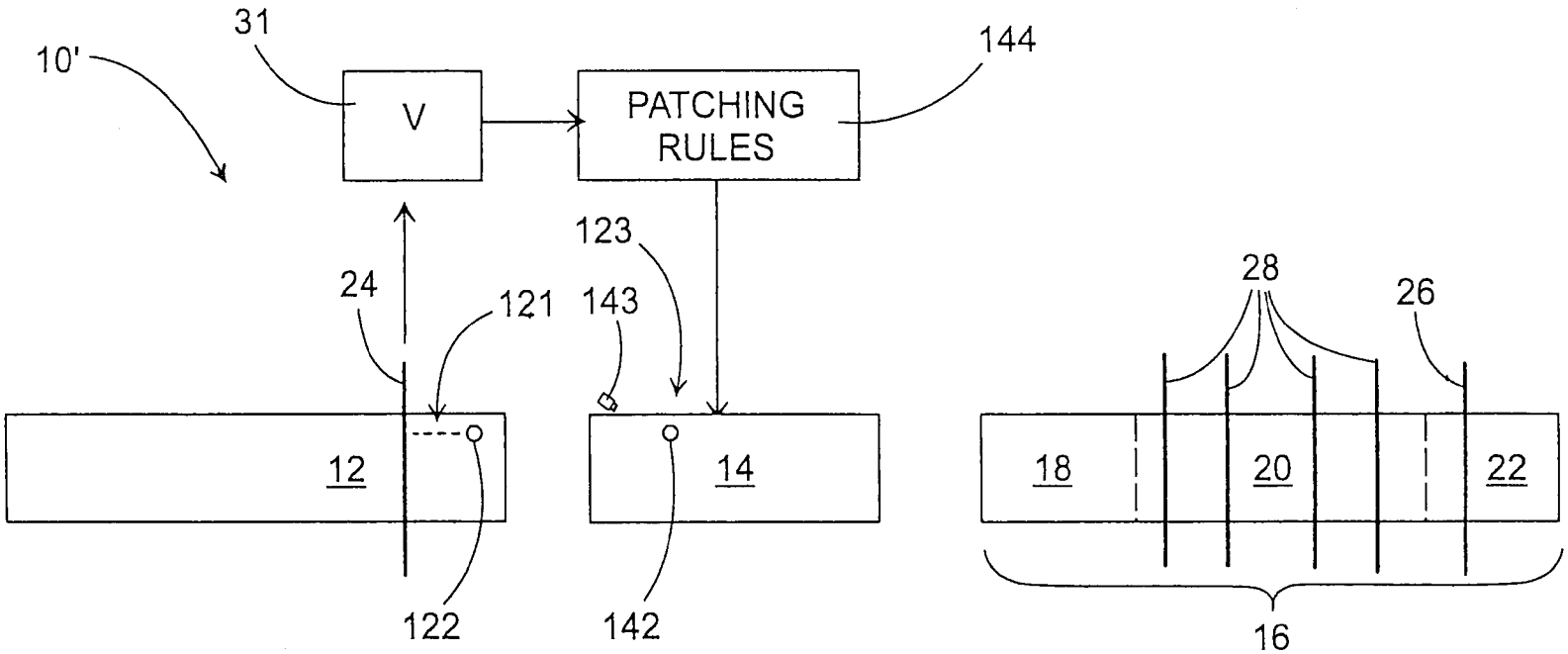
Fig. 1a Prior Art
FIG. 1*a* shows a system according to the prior art, on a re-reeler and off-line coating machine.

FIG. 1*a* shows a system 10' according to the prior art, in which first of all a web is manufactured on a paper machine 12. The manufactured web is re-reeled, cut to a standard width, and patched on the re-reeler 14, after which the web in question is coated on an off-line coating machine 16. The coating machine 16 is roughly divided into three parts, i.e. unwinding 18, the coating section 20, and winding 22. After the coating machine, coating lumps and streaks are removed from the web on a second re-reeler (not shown). After this, the web can be calendered. It is possible to use the same re-reeler in the removal of coating lumps and streaks after the coating machine as in the re-reeling taking place before the coating machine, but typically a second re-reeler is used for re-reeling after the coating machine.

In the system according to the prior art shown in FIG. 1*a*, a defect map is created on the defects in the webs prior to coating, for display to the operator of the coating machine. The defect map 31 is created with the aid of image processing based on the image material imaged by the defect-detector cameras 24 on the fibre-web machine 12 and on pattern recognition. The set of co-ordinates of the paper web is marked on the web itself with digital colour codes 121 at regular intervals and the area between them is measured by a tachometer 122. With the aid of these, each item on the defect map is linked to precise co-ordinates.

A colour-code reader 143 and a tachometer 142, by means of which it is possible to run to the positions of the defect points and perform patching according to the preset patching rules 144, are used at the re-reeler 14. Suitable software is used to filter out from the defect map 31 all defects that have been shown by experience not to cause harm. The reader gives the distance of the next deviation three times a second and the remaining time and distance to the following deviation is displayed to the operator. The rest of the defects are shown to the patcher for repair.

In the system of FIG. 1*a*, the quality after coating is monitored using defect-detection cameras 26 after the coating section 20. By means of these defect-detection cameras, a new defect map of the web is created. In the newest systems, the defect maps created before and after coating are displayed to the operator simultaneously. On the basis of the defect maps, the quality of the web arriving at coating after it leaves the fibre-web machine as well as the quality of the web after coating.

However, the system according to the prior art does not provide information as to the stage at which problems appear in the coating section. The typical length of the web circulating through the coating section is several hundred meters, for example 300 m. If break occurs, it can typically be seen from the defect map that there are several deviations in the coating section that could have caused the break. Using imaging that takes place before coating, it cannot be decided with certainty which of the deviations possibly caused the web break. In such a case, imaging after coating provides no information on the break. Typically, the operator guesses that the break has been caused by the largest deviation visible in the defect map, but in reality some other deviation may have caused the break and thus be considerably more significant. In addition, the break may be caused by a deviation that does not even appear in the defect map.

In the system 10' according to the prior art shown in FIG. 1*a*, the information provided by the break detectors 28 in the coating section 20 tells at what point the web deviation has been. However, this information is very imprecise, as several tens of meters, for example 60 m of web typically run between the break detectors. Such accuracy is not sufficient to assess which deviation caused the break. In addition, the break detectors only provide information on breaks. In systems according to the prior art, information on breaks is received with a considerable delay. When the speed of a coating machine is 2400 m/min, the interval between break cameras is, according to the route of the web, 60 m. If a break occurs halfway between break cameras, notification of the break will be received and recorded in the system 0.75 seconds after the occurrence of the break. Information is typically received from the system for interpretation only tens of seconds after recording.

Figure 1B:
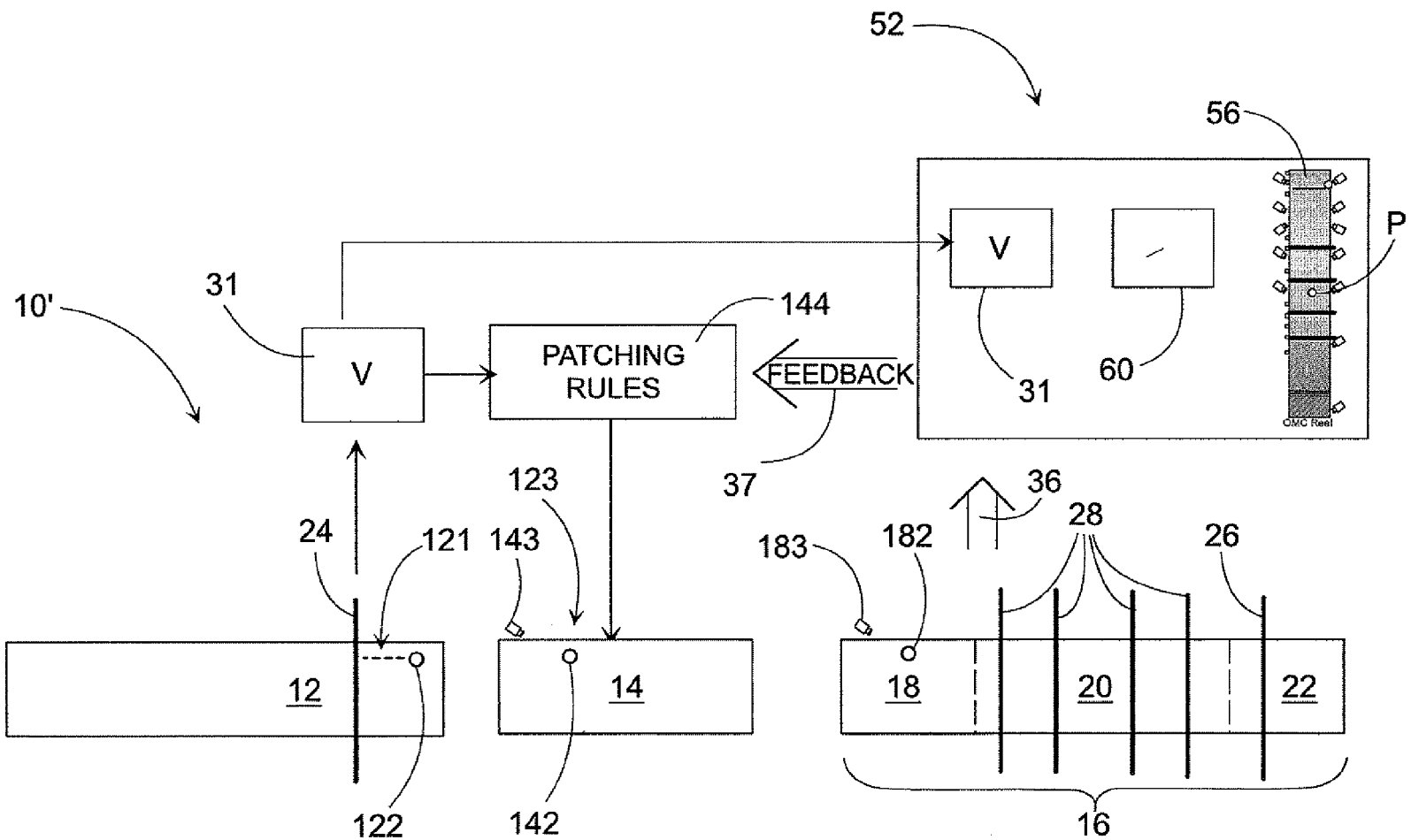
FIG. 1*b* shows a system according to the invention, on the paper machine of FIG. 1*a*.

FIG. 1*b* shows a system 10 according to the invention, improved from the system 10' of FIG. 1*a*. In this case too, the web is manufactured first on a paper machine 12. In their main features, the re-reeler 14 and its patching rules 144 and the off-line coating machine 16 are similar. In the system 10 according to the invention, the defect map 31 is also utilized by the coating machine 16 and the coating-machine operator provides feedback for changing the patching rules 144 to be optimal relative to the paper being manufactured and for maintaining the patching rules 144.

In this case, in order to maintain and optimize the patching rules the coating machine is equipped with a code reader 183 and a tachometer 182, by means of which each deviation in the defect map 31 can be located quite precisely (±50 cm). The system includes display means 52, in which it is possible to follow the location of each defect P through the coating machine (machine screen 56). When the deviation P travels in the image from the top down, and a possible break occurs precisely at the location of the deviation at that moment, it can be concluded that such a deviation P is critical and it can be classified to be patched in the patching rules. Correspondingly, a correction can be made in the running parameters of the paper machine, if the correction should be made already on the paper machine. Each deviation that is classified to be monitored is monitored through the entire coating machine. In FIG. 1*b*, the feedback to the patching rules 144 is marked with the reference number 37.

The coating machine 16 preferably has its own machine-vision system, so that additional information in support of a conclusion as to whether the defect is significant can be attached to each defect. Such an own machine-vision system is useful, because a specific type of defect does not cause a break immediately, but only once it accumulates, for example only 50 m later. An own machine-vision system reveals such cases, when the defect location, for example a roll, can be monitored stage by stage. A considerable dispersion relates to the behavior of defects, so that there is reason to monitor more closely certain types of deviation, such as thinnings, detached fibre threads, and glue accumulations. The coating machine's own machine-vision application also permits the examination of 'near-miss' situations. This is because deviations appear now and then on the coating machine, which are clearly close to causing a web break, but the web is able to the wound before the web break occurs. Such deviations can be avoided with the aid of feedback, i.e. the patching rules are examined correspondingly.

Figure 2:
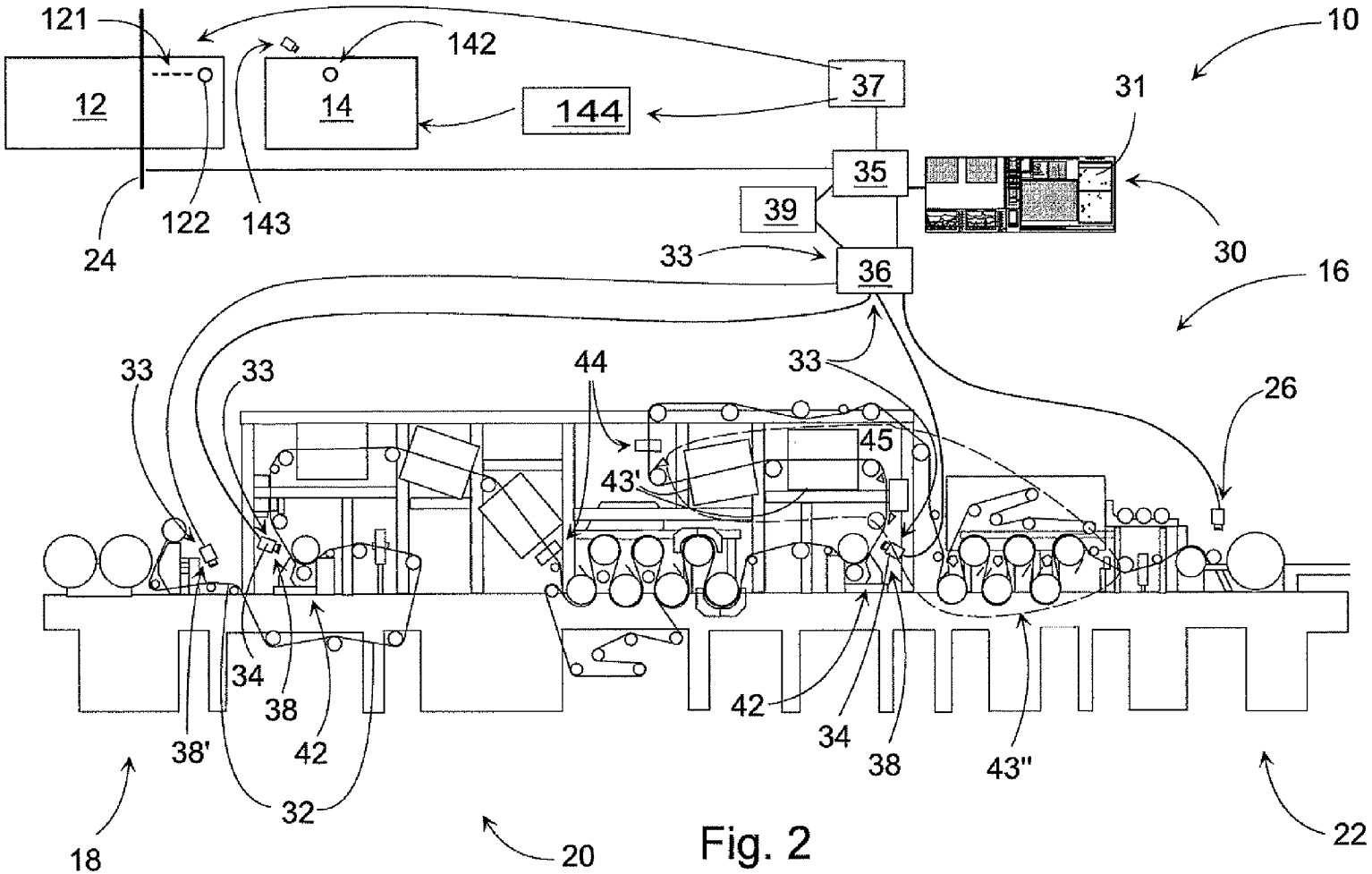
FIG. 2 shows the system according to the invention, on an off-line coating machine.

FIG. 2 shows the system 10 according to the invention for monitoring deviations in the web 32 being coated, on an off-line coating machine 16. The coating machine 16 includes an unwinder 18, a coating section 20, and a winder 22. The system 10 on the coating machine 16 includes monitoring means for detecting deviations detected in the web before the coating section and display means 30 for displaying the deviations in the web 32 before the coating section 20 as a defect map 31. In addition, the system 10 includes means 38 for monitoring the web 32 in the coating section 20 and for finding deviations in the web 32, i.e. distinguishing them using selected criteria. The system also includes analysis means 35 for connecting each deviation with a deviation shown in the defect map 31 using selected criteria, or ascertaining it to be a new deviation. In addition, the system includes display means 30 for showing the selected deviations in at least one selected position. When the web being coated is also monitored in the coating section, additional information is obtained as to the kinds of deviation that can cause problems. The increased information permits dangerous deviations to be removed or reacted to better than previously. In other words, the preceding process stages can be given information as to the types of deviation that should be reduced in the web arriving at coating, in terms of the coating process. It is also possible to react to deviations more quickly than before and make a controlled break in the coating section using break blades, in which case the coating event can be got running again considerably faster than in the case of an uncontrolled break.

By using the system according to the invention on an off-line coating section, information is obtained on deviations that worsen at the coating section. All the information obtained from a worsening deviation is displayed to the operator and recorded. This allows worsening deviations to be reacted to when they are already in the coating section. Information on the worsening of deviations permits, for example, the break blades to be used before a break is caused. In systems according to the prior art, for their part, information is not obtained on deviations that worsen in the coating section without causing a break when they are in the coating section. Information on the worsening of deviations is obtained only once the deviation has gone through the entire coating section, when a new defect map is imaged. However, many deviations worsen first at one coating station and break only at the following one. When using an off-line coating section according to the prior art, there is no possibility to react to a worsening deviation, as information about it is not obtained.

The analysis means 35 belonging to the system according to the invention, shown in FIG. 2, are real-time analysis means. Using real-time analysis means, the analysis results are shown quickly, bound to the defect map, preferably within one second. Thus, there is no significant delay in the system, but instead the operator sees animated on the display, for example, a hole that has enlarged at a coating station before the hole reaches the following coating station. The real-time analysis means permit the event chains of deviations to be displayed to the operator in real time. In other words, an event chain is created between the defect map created before the coating section and the coating section. The event chain is preferably created by calculating default position data for deviations found on the fibre-web machine and appearing in the defect map, and comparing the position data of the deviations detected at the coating section with the default position data of deviations detected previously using selected criteria.

The system 10 according to the invention, shown in FIG. 2, includes feedback-issuing means 37 for giving feedback to a process stage preceding the coating machine 16, such as the re-reeler 14 (patching rules) or the fibre-web machine 12, on the basis of monitoring taking place on the coating section 20. The feedback-issuing means 37 are part of the system 10 and can be used to tell the previous process stages that are the deviation types about which something should be done. The giving of feedback can be performed, for example, by marking in the system the deviations interfering with coating, about which it is wished to notify the preceding process stages. The deviations interfering with coating can cause a break or worsen at the coating section. The giving of feedback can be marked by defining new criteria, by means of which it indicates defects. The feedback is preferably given to the re-reeler, so that at the re-reeler points, which earlier were permitted to enter the coating machine as such, can be reinforced or cut out. Through time, the conditions in question can be made more precise by learning more about deviations that cause problems at the coating section. With the aid of the feedback-issuing means, the patching rules can be refreshed the whole time. The system permits better patching and removal of the correct deviations than previously, as through time the system can be made very precise in terms of which type of deviation should be dealt with before the coating machine.

The system 10 according to the invention, shown in FIG. 2, includes, between the unwinder 18 and the coating section 20, means 38' for monitoring the web between the unwinder 18 and the coating section 20. The means 38' in question are preferably machine-vision means 33. The means 38' in question for monitoring also show edge fraying and creases, which have arisen on the machine reeler. Also defects that have arisen at the re-reeler 14 are seen by the means 38' for monitoring the web 32, even though defects seldom arise at the re-reelers. This makes it possible to react to the deviations in question, which cannot be seen in the defect map images from the fibre-web machine and synchronized for the off-line coating machine. For example, a pale patch, which has not appeared on the fibre-web machine will probably be a wrinkle that has arisen during reeling. A wrinkle that has arisen during reeling may cause a break at the coating section. The defect-detector cameras for making the defect map more precise provide important additional information through this.

The system 10 shown in FIG. 2 includes synchronization means 39, by means of which synchronization is arranged to be implemented on the basis of the web-monitoring means 38' between the unwinder 18 and the coating section 20, i.e. on the basis of the information obtained from them. The synchronization means 39 are between the process means 36 and the analysis means 35, in which case the information coming from the web-monitoring means 38 is led, when desired, to the synchronization means. Thus, the web-monitoring means, typically machine-vision means, between the unwinder and the coating section, can be used to synchronize the defect map. When the defect map is synchronized on the basis of the speed of the web and, for example, the synchronization marks are one-kilometer intervals, the synchronization can slip by even ten meters before the following synchronization mark. When synchronizing the defect map using, in addition to this, the machine-vision means belonging between the unwinder and the coating section, the synchronization is made more accurate and certain than previously.

The coating section according to the invention, shown in FIG. 2, belongs at least one coating station 42 and drying station 43. The drying stations 43 belonging to the coating section 20 form a drying section 45. The last of the drying sections 45 belonging to the coating section 20 is surrounded by a broken line. Thus, the coating section 20 includes a drying section 45, which consists of, for example, two air-float drying stations 43' and a cylinder drying station 43". At the coating station 42, there is a camera 34 belonging to the machine-vision means 33 for monitoring the web 32 in connection with the coating station 42. There are typically several cameras at the same position, their number being determined according to the intended imaging precision. The camera can also be part of a camera beam, which is typically used in a defect-detection apparatus. For their part, the break cameras are typically separate and thus not part of a camera beam. By monitoring the web at the coating station, more breaks caused by deviations will be seen than by imaging the web elsewhere in the coating section, as typically about 80% of breaks occur at the coating station. When the events at the coating section are seen immediately, reaction to deviations will be faster. Thus, for example, the break blades can be operated more quickly than previously. The web 32 is preferably imaged in connection with all the coating stations 42 belonging to the coating section 20.

The break-monitoring means 44 belonging to the coating machine according to the invention, shown in FIG. 2, are connected to the system 10. The cables used to connect the break-monitoring means to the system are not shown. If a break occurs elsewhere than next to a camera in the defect-detecting apparatus, the first notification of the break will be obtained using the break-monitoring means. Cameras as part of the defect-detection apparatus are typically particularly at the coating stations while the break-monitoring are between the coating stations. The means 38 for monitoring the web 32, belonging to the coating machine according to the invention, shown in FIG. 2, are machine-vision means 33. Using the machine-vision means 33, the web 32 is monitored at the coating section 20 and deviations in the web 32 are distinguished by means of selected criteria. The machine-vision means 33 include cameras 34 for imaging the web 32 and process means 36 and software for detecting deviations.

Figure 3:
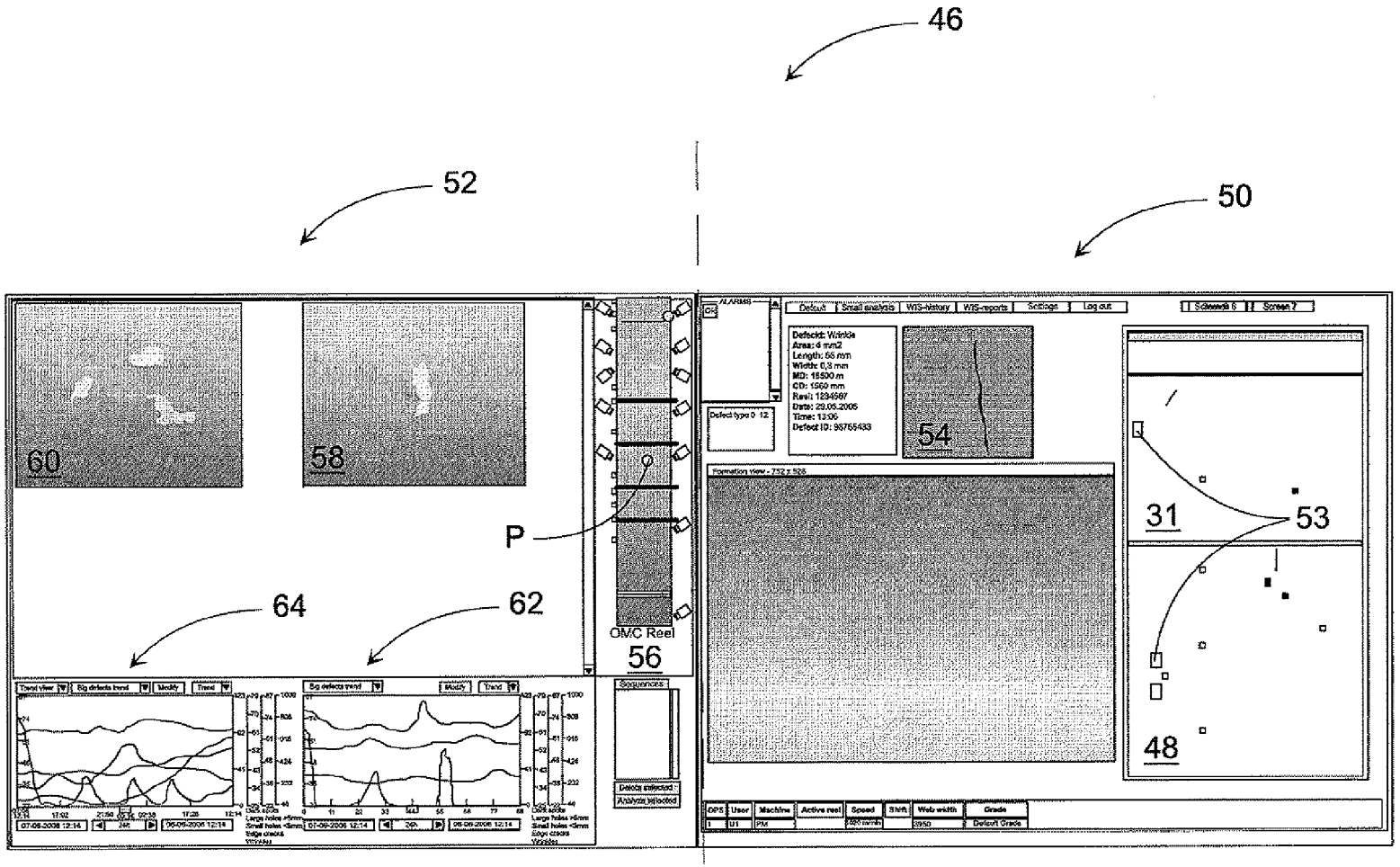
FIG. 3 shows the user interface of the system according to the invention.

FIG. 3 shows a user interface 46 for operating the system according to the invention. A defect map 31, imaged on the fibre-web machine and synchronized on the coating machine, is displayed in the upper right-hand corner of the user interface 46. A defect map 48 based on the information imaged after coating is displayed beneath the defect map 31 based on the information imaged on the fibre-web machine. Information on the deviations visible in the defect maps 31, 48 is displayed in the right-hand half 50 of the user interface, in addition to the defect maps 31, 48. By clicking on a marking 53 illustrating a deviation in a defect map 31, 48, a defect image is obtained in the screen 54. The defect image shows in detail the deviation in question.

Information from the coating section is shown in the left-hand side 52 of the user interface. Thus, information that has not previously been displayed is displayed in the left-hand side. In the upper right-hand corner of the left-hand side 52 is a machine screen 56, from which the operator sees the configuration of the coating unit, as well as at which positions the cameras are. When the deviation moves out of the defect map 31, i.e. when the deviation moves to the coating section, the deviation is monitored from the machine screen 56 on the coating section with the aid of virtual monitoring. The deviation can be seen on the coating machine shown on the machine screen 56. When the deviation has gone through the coating section the deviation is shown in the defect map 48. Deviations that have been found only in the coating section can also be seen in the machine screen. Two of the most significant deviations in the coating section, i.e. which appear in the machine screen 56, are monitored virtually through the entire coating section, by displaying animated images of them automatically in the screens 58 and 60, in each imaging position in which the deviations are detected. In other words, the two or three most significant deviations P are monitored virtually through the entire coating machine 16, by displaying animated images of them automatically at each moment relative to the coating machine. The deviations shown in the screens 58 and 60 can be viewed afterwards from the screen 54 in the right-hand side 50 of the user interface. In addition, all of the information collected on the deviation in question can be read in the right-hand half of the user interface. Statistical data on the deviations detected in the coating section are displayed in the screens 62 and 64.

The deviations that meet the selected criteria obtained from the register are shown at the initial point of the animation, which refers to the start of the coating machine. The location of a deviation through the coating machine is monitored in animation from the machine screen 56 while animated images of the deviations are shown at the imaging positions.

The method and corresponding system according to the invention combine web monitoring and web-break analysis in a single totality. All process disturbances causing deviations or web breaks are recorded and displayed automatically. By means of the method and system according to the invention in their totality, an increase of as much as 13% in overall efficiency can be achieved on a process line.

The invention claimed is:

1. A system in connection with a paper machine re-reeler, and an off-line coating machine, in which the paper machine forming a web includes means for creating a defect map showing deviations and displaying the defect map to an operator, and the system includes a computer application for maintaining patching rules and for guiding patching using the re-reeler according to the patching rules, and the off-line coating machine has means for displaying selected deviations to the operator, wherein the system includes means for monitoring a virtual location of a deviation through the off-line coating machine and, if a possible web break occurs, for localizing the deviation relative to the web break, and means for providing feedback based on this monitoring to the patching rules of the re-reeler, in order to optimize them, and the system includes a display on the coating machine and processor means arranged to display virtually the location of a deviation through the off-line coating machine, the processor means calculating a momentary location of the deviation relative to the off-line coating machine.

2. The system according to claim 1, wherein the system includes a colour-coding element and a tachometer on the paper machine for marking a set of co-ordinates on the defect map and correspondingly a code reader and a tachometer on both the re-reeler and the off-line coating machine, in order to read the set of co-ordinates of the defect map.

3. The system according to claim 1, wherein the system further includes means for monitoring the web at a coating sector and for finding deviations in the web using selected criteria, and real-time analysis means for connecting each deviation with a deviation shown using selected criteria in the defect map, or ascertaining the deviation to be a new deviation, wherein the display shows selected deviations in at least one selected position.

* * * * *